United States Patent [19]

Williams

[11] 4,350,380

[45] Sep. 21, 1982

[54] LOAD CARRYING SLINGS

[76] Inventor: William C. Williams, 47, Channel View, Port Talbot, Glamorgan, Wales

[21] Appl. No.: 132,013

[22] Filed: Mar. 20, 1980

[30] Foreign Application Priority Data

Mar. 27, 1979 [GB] United Kingdom ..... 7910557

[51] Int. Cl.[3] ..... B66C 1/18

[52] U.S. Cl. ..... 294/74

[58] Field of Search ..... 294/74–77, 294/78 R; 24/16 R, 122.3; 217/66, 69; 224/49

[56] References Cited

U.S. PATENT DOCUMENTS

| | | | |
|---|---|---|---|
| Re. 26,704 | 11/1969 | Norton | 294/74 |
| 1,168,802 | 1/1916 | Harrison | 294/74 |
| 1,314,397 | 8/1919 | Heffron | 294/74 |
| 2,793,904 | 5/1957 | Gale | 294/74 |
| 2,960,365 | 11/1960 | Meisen | 294/74 |
| 3,310,333 | 3/1967 | Hutson | 294/74 X |

FOREIGN PATENT DOCUMENTS

| | | | |
|---|---|---|---|
| 20876 | of 1909 | United Kingdom | 294/74 |
| 1050789 | 12/1966 | United Kingdom | 294/74 |

*Primary Examiner*—Johnny D. Cherry

*Attorney, Agent, or Firm*—Trexler, Bushnell & Wolters, Ltd.

[57] ABSTRACT

A load carrying sling including a protective sheath 15 over the rope 10 with loops 11,12 at opposite ends, the sheath being formed of a tough resilient plastics material and having a thick protective layer 18 on the inner surface of the sling with a number of openings in the back of the sheath between the side walls 19. The openings can be closed by a removable block 23 when the sling is used as a choke hitch. Alternatively, the whole sheath may be formed of a transparent flexible material to allow inspection of the rope.

7 Claims, 5 Drawing Figures

LOAD CARRYING SLINGS

For lifting heavy loads by means of a crane or the equivalent it is common to use a sling having a loop or eye at each opposite end, the main part of the sling being in the form of a rope or cable or a flat strap.

Existing slings suffer from several disadvantages. They are liable to heavy wear in use and are often damaged by or cause damage to the load being lifted. It is possible to provide protective pads or sheaths but the pads themselves may be damaged and may work lose and in any case it is important that any damage to or weakness in the sling should be clearly apparent.

It is an object of the invention accordingly to provide an improved skling which will meet at least some of the present problems and requirements.

Broadly stated the invention consists in a sheath for a load carrying sling, formed at least partly of a transparent material or having an opening through which an internal flexible load-carrying tensile member is visible.

Preferably the back of the sheath is cut away or has an opening, and includes means for closing or protecting the opening for use as a choke hitch. The sheath is conveniently of generally channel or hollow box section, and has a layer of tough resilient material on its inner face. It is preferably moulded as a one piece unitary body in a synthetic plastics material.

The invention also consists in a sling including such a sheath and having a rope or other flexible tension element located therein, the sheath being moveable lengthwise on the tension element.

Figure 1:
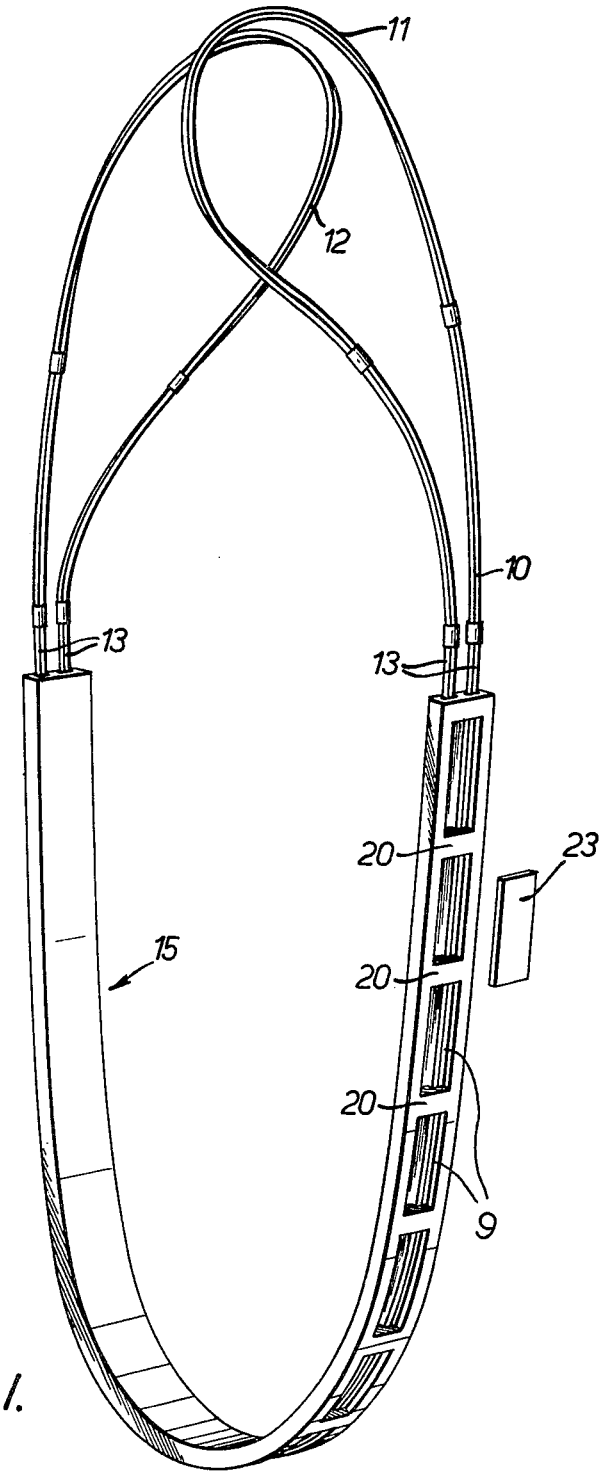
Figure 2:
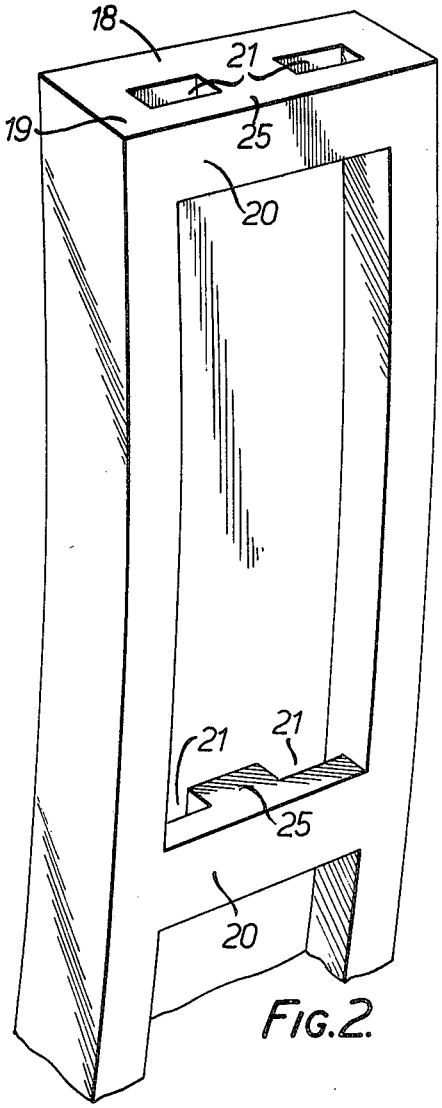
Figure 3:
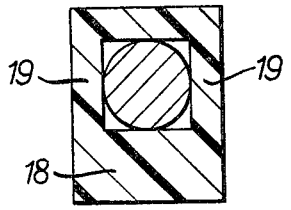
Figure 4:
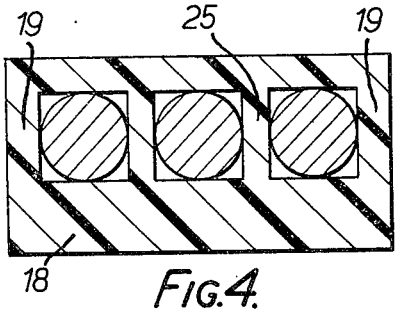
Figure 5:
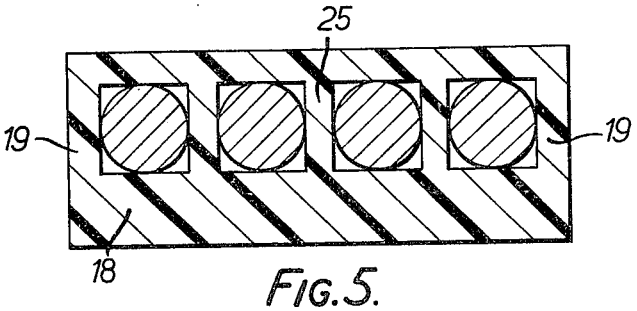

The invention may be performed in various ways and one specific embodiment with some possible modifications will now be described by way of example with reference to the accompanying drawings, in which:

FIG. 1 is a general perspective view illustrating one form of sling according to the invention, FIG. 2 is a perspective view on an enlarged scale illustrating one end of the sheath with the cables omitted for clarity, and FIGS. 3, 4 and 5 are end views of alternative forms of sheath for use with single, treble or quadruple ropes.

Referring first to FIGS. 1 and 2, the sling comprises a basic tensile loop of wire rope 10 which provides a pair of eyes or loops 11,12 at the ends, with an intermediate lifting sling portion consisting of a pair of parallel rope lengths 13. The ropes may be in one or more lengths joined by Talurit (RTM) splines, clamping sleeves, or other means.

Over the intermediate part 13 of the sling a protective sheath 15 is provided. This is formed of a flexible tough resilient material such as polyurethane elastomer, e.g. DUPONT L100. On the inner surface of the sling the sheath provides a layer of protective material 18 which is of at least the same thickness as the diameter of the wire rope. This extends the full width of the sling which is thus in effect a flat belt, wider than it is thick, and has integral projecting side walls 19 which define a channel in which the twin ropes 13 lie. The back of this channel is spanned at intervals by integral webs or transverse bridges 20, each formed with a pair of spaced apertures 21 to accommodate the ropes. The ropes are preferably loose in the apertures and the whole sheath is therefore free to move within limits along the sling.

The ropes are visible through viewing window apertures 9 along the back of the sling and framed by the material of the sheath to include the bridges separating the viewing apertures, and by moving the sheath a short distance lengthwise the full length of each rope can be inspected. Alternatively, the back of the sheath or the whole sheath may be moulded in a clear transparent synthetic resin, so that the whole length of each rope can be inspected on all sides for possible damage.

In some cases the sling may be used as a "choke hitch" in which one end of the sling is passed through the loop at the other end. When the choke hitch is pulled tight the second loop engages the back of the sling and to protect the sling in such cases a detachable block 23 is provided to fit into the back of the open channel between two of the bridges. This block may include a number of permanent magnets to hold the block in position against the wire ropes, until the block is to be removed or shifted to a different position. Other means for holding the block in place may be provided. For example, there may be a snap acting pressure fit between the block and the resilient material of the side flanges or bridge pieces of the sheath.

FIGS. 3, 4 and 5 are cross sections through alternative forms of sheath illustrating its use with one, three or four wire rope lengths. Ropes or straps of other constructions and materials may be used.

In the examples described where each of the webs has a central pillar 25 between the two apertures 21 the wire rope must be spliced or joined to form the end loops after the sheath has been put in position in the sheath. If each web is formed with a single enlarged full width aperture the wire rope may be spliced or joined beforehand and then inserted through the bridge openings in the sheath.

There may also be provided a rope clamp in the form of two metal straps which are tightened across all the ropes or cables, and located in each of the end openings at the back of the sheath. Thus if the sheath should become trapped by external forces, when the sling is being removed from a load, the rope clamp will assist in pulling it clear, without buckling.

If the sling is used on a heavy load with a sharp edge or corner, the block 23 may be inserted in position between the ropes and the sheath, to provide added protection.

Instead of the block 23 there may be a moulded sleeve, surrounding the sheath, and movable lengthwise to the required position when the sling is used as a choke hitch.

I claim:

1. A load carrying sling comprising an internal flexible load carrying tension element, and a flexible sheath formed with passage means for receiving said tension element, said sheath extending over a substantial length of said tension element and being formed with a plurality of longitudinally spaced viewing apertures peripherally framed by the material of the sheath to include transverse bridges separating the viewing apertures and providing adjacent walls of the passage means whereby substantially all parts of said element can be inspected and substantially the full length of said element is protected.

2. A sling as claimed in claim 1, wherein at least part of said sheath is made from transparent material.

3. A sling as claimed in claim 1, wherein said sheath has an inner front face and an outer reverse side and is formed with the plurality of apertures on the reverse side thereof.

4. A sling as claimed in claim 3, including movable means for closing said apertures, when the sling is in use.

5. A sling as claimed in claim 3, wherein said sheath has a continuous layer of tough resilient material over substantially the whole of its inner face.

6. A sling as claimed in claim 3, wherein pillars project from the bridges to the adjacent surface of the inner face of the sheath providing side-by-side passages for tension elements.

7. A sling as claimed in claim 1, wherein the sheath is a one piece integral unitary body in a synthetic plastics material with relatively narrow bridges separating the viewing apertures and with the sling being movable within limits along said tension element over a distance at least equal to the width of said bridges for inspection purposes.

* * * * *